US006006737A

United States Patent [19]

Hayashi et al.

[11] Patent Number: 6,006,737

[45] Date of Patent: Dec. 28, 1999

[54] DEVICE AND METHOD FOR CUTTING SEMICONDUCTOR-CRYSTAL BARS

[75] Inventors: Yoshikazu Hayashi; Masanori Hashimoto, both of Kanagawa, Japan

[73] Assignee: Komatsu Electronic Metals Co., Ltd., Kanagawa, Japan

[21] Appl. No.: 09/015,245

[22] Filed: Jan. 29, 1998

[30] Foreign Application Priority Data

Jan. 29, 1997 [JP] Japan ..... 9-028262

[51] Int. Cl.[6] ..... B28D 1/08

[52] U.S. Cl. ..... 125/16.02; 125/21

[58] Field of Search ..... 125/16.02, 21; 83/651.1

[56] References Cited

U.S. PATENT DOCUMENTS

| | | | |
|---|---|---|---|
| 5,201,305 | 4/1993 | Takeuchi | 125/16.02 X |
| 5,269,285 | 12/1993 | Toyama et al. | 125/16.02 X |
| 5,429,163 | 7/1995 | Frenkel et al. | 83/651.1 X |

FOREIGN PATENT DOCUMENTS

| | | | |
|---|---|---|---|
| 0591328 | 2/1978 | Russian Federation | 125/16.02 |

*Primary Examiner*—David A. Scherbel
*Assistant Examiner*—Anthony Ojini
*Attorney, Agent, or Firm*—Sughrue, Mion, Zinn, Macpeak & Seas, PLLC

[57] ABSTRACT

A plurality of wires are stretched in parallel through wire supplying-winding apparatuses and wire-tension adjusting apparatuses. A semiconductor-crystal bar is affixed on an ascent/descent table via a feeding table. The ascent/descent table is capable of being driven to ascend or descend by the ascent/descent apparatus. The wires and the semiconductor-crystal bar are dipped into a high-insulation oil, and discharging is created therebetween to perform cutting. If the resistance of the semiconductor-crystal bar exceeds 1 Ω·cm, used inert gas is filled into a space within the interior space of an airtight vessel. Then, the high-insulation oil is heated by heaters and is kept at a temperature higher than 150° C. to reduce the resistance of the semiconductor-crystal bar. Therefore, cutting is easily performed. The used inert gas can prevent fire from occurring due to the flaming of the high-insulation oil.

7 Claims, 2 Drawing Sheets

DEVICE AND METHOD FOR CUTTING SEMICONDUCTOR-CRYSTAL BARS

BACKGROUND OF THE INVENTION

1. Field of the Invention

The present invention relates to a device and a method for cutting semiconductor-crystal bars.

2. Description of the Related Art

Conventionally, single-crystal silicon ingots, polycrystalline silicone ingots, or compound semiconductor ingots (hereinafter referred to as semiconductor-crystal bars) are cut into wafers or blocks by employing the following methods: namely, a method using an internal-blade grind wheel, the thin doughnut shaped internal rim of which is bonded with grind particles such as diamonds; a method using an endless band saw that is a thin-link shaped strip steel with grind particles such as diamonds bonded thereon; or a wire-saw cutting method in which a thin piano wire is shifted constantly so as to cut a semiconductor-crystal bar by segregated grind particles.

However, for the cutting processes in which internal blades or endless band saws are utilized, thin plates bonded with grind particles such as diamonds are used. Accordingly, it is difficult to slice a semiconductor-crystal bar into wafers of thinness less than 0.2 mm. In addition, the outer rims of the wafers break off easily. In the method that utilizes wire saws, it is necessary regularly to exchange the piano wires which become thin. Furthermore, oil-rich grind particles are used; therefore treating waste fluid or cleaning the oil sticking on the wafers is a time-consuming and costly process.

SUMMARY OF THE INVENTION

In light of the drawbacks described above, the object of the present invention is to provide a device and a method for cutting semiconductor-crystal bars capable of cutting various semiconductor-crystal bars, including single-crystal silicon ingots rapidly at low cost.

To achieve the above object, the device for cutting semiconductor-crystal bars comprises a plurality of wires stretched in parallel; means for shifting the wires constantly along the axis of the said wires; means for supplying electric current to the wires; means for heating a high-insulation oil into which the wires and a semiconductor-crystal bar to be cut are dipped; means for holding the semiconductor-crystal bar and shifting in the vertical and the horizontal directions; an airtight vessel for accommodating the above means; means for supplying and expelling inert gas that is filled into a space within the airtight vessel and above the high-insulation oil; and means for supplying and expelling the high-insulation oil.

The device for cutting semiconductor-crystal bars according to this invention is a cutting device employing Electric Discharge Machining Technology. The current supplying supplies electric current to the wires being shifted along their own axes, and cutting operations are performed by holding the semiconductor-crystal bar and shifting it in the vertical and the horizontal directions. Therefore, it is unnecessary to supply the means to provide grind-particles or cooling-water, as is required for conventional internal-blade type cutting machines and endless band saw machines. Furthermore, inert gas is filled into the space within the airtight vessel and above the high-insulation oil. Accordingly, it is possible to heat the high-insulation oil by the heating means.

In the method for cutting semiconductor-crystal bars according to the present invention, electric current is supplied to the stretched wires, and a semiconductor-crystal bar is cut through electric discharging rendered by electric current.

It has been considered indisputable that a metal bar with electric conductivity is capable of being cut by using Electric Discharge Machining Technology, however semiconductors with partial insulation at room temperature are difficult to cut. The inventors of this invention found through experiments that semiconductors could be cut even at room temperature, and there was only insignificant pollution such as color-change existing in an extremely shallow surface layer. Therefore, it is clear that such technology can be put to use. In particular, even at room temperature, if a semiconductor-crystal bar is supplied, then it can be cut to a satisfactory standard.

Further, in the method for cutting semiconductor-crystal bars according to the present invention, the cutting operation is performed after heating a semiconductor-crystal bar to a temperature higher than room temperature.

The resistance of the semiconductor-crystal bar to cutting will be reduced when the temperature of the semiconductor-crystal bar is raised above room temperature, and enough current for cutting can pass through the semiconductor-crystal bar and the wires. Thus, the semiconductor-crystal bar can be cut to a satisfactory standard by heating the semiconductor-crystal bar to reduce its resistance.

In the method for cutting semiconductor-crystal bars according to the present invention, cutting is performed in an inert gas atmosphere.

Therefore, the amount of oxidation film formed during cutting is reduced, and color-change is extremely minor. Pollution can exist in an extremely shallow surface layer only.

Furthermore, the method for cutting semiconductor-crystal bars according to the present invention is carried out by filling with inert gas a space within an airtight vessel and above a high-insulation oil stored therein, and creating electric discharging between a semiconductor-crystal bar and a wire, both of which are dipped into the high-insulation oil. The method which is the subject of this invention is characterized by the fact that the cutting operation is performed after heating and keeping the high-insulation oil at a temperature higher than 150° C. to reduce the resistance of the semiconductor-crystal bar.

The semiconductor-crystal bar can be easily cut out, if electric discharging is induced between the semiconductor-crystal bar and the wires, both of which have been dipped into the high-insulation oil within the airtight vessel. However, if the resistance of the semiconductor-crystal bar is high, electric discharging is difficult to induce. If the high-insulation oil is heated and kept at a temperature higher than 150° C., then the resistance of the semiconductor-crystal bar is reduced and electric discharging is easily induced. Thus, cutting operations can be maintained at a speed in compliance with the needs of the industry. Furthermore, inert gas is filled into the space within the airtight vessel and above the high-insulation oil while the cutting of the semiconductor-crystal bar is carried out. When a semiconductor-crystal bar with high resistance is being cut, the high-insulation oil has to be heated and kept at a temperature higher than 150° C. so as to reduce the resistance of the semiconductor-crystal bar. Under these circumstances, the high-insulation oil will burn up if air or oxygen is present within the airtight vessel. Filling the space with inert gas such as Argon in advance can prevent the burning of the high-insulation oil.

BRIEF DESCRIPTION OF THE DRAWINGS

The present invention can be more fully understood by reading the subsequent detailed description and examples with reference made to the accompanying drawing, wherein.

PREFERRED EMBODIMENT OF THE INVENTION

Figure 1:
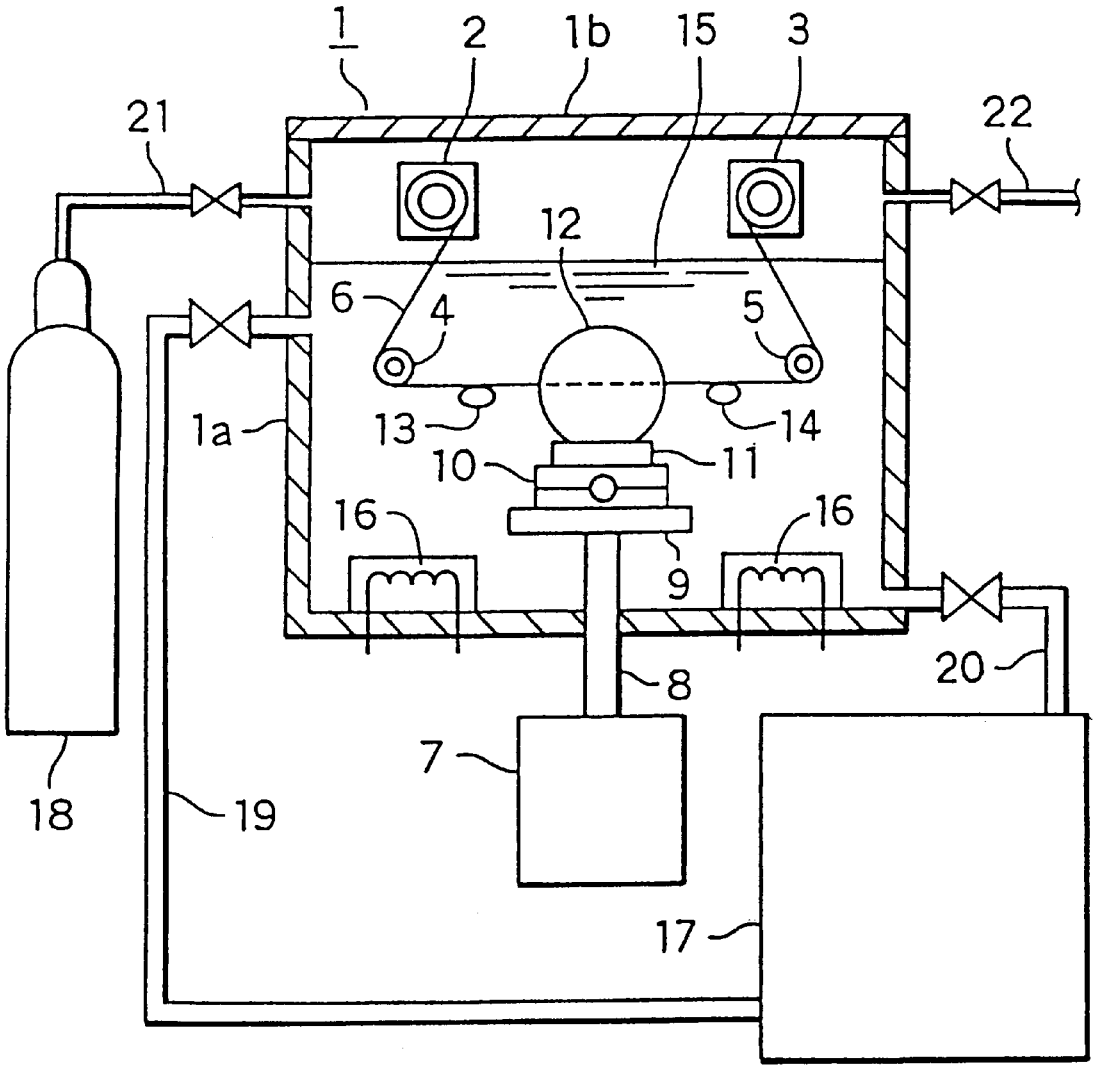
FIG. 1 is a schematic cross-sectional view showing the structure of the device for cutting semiconductor-crystal bars that is the subject of this invention.
Figure 2:
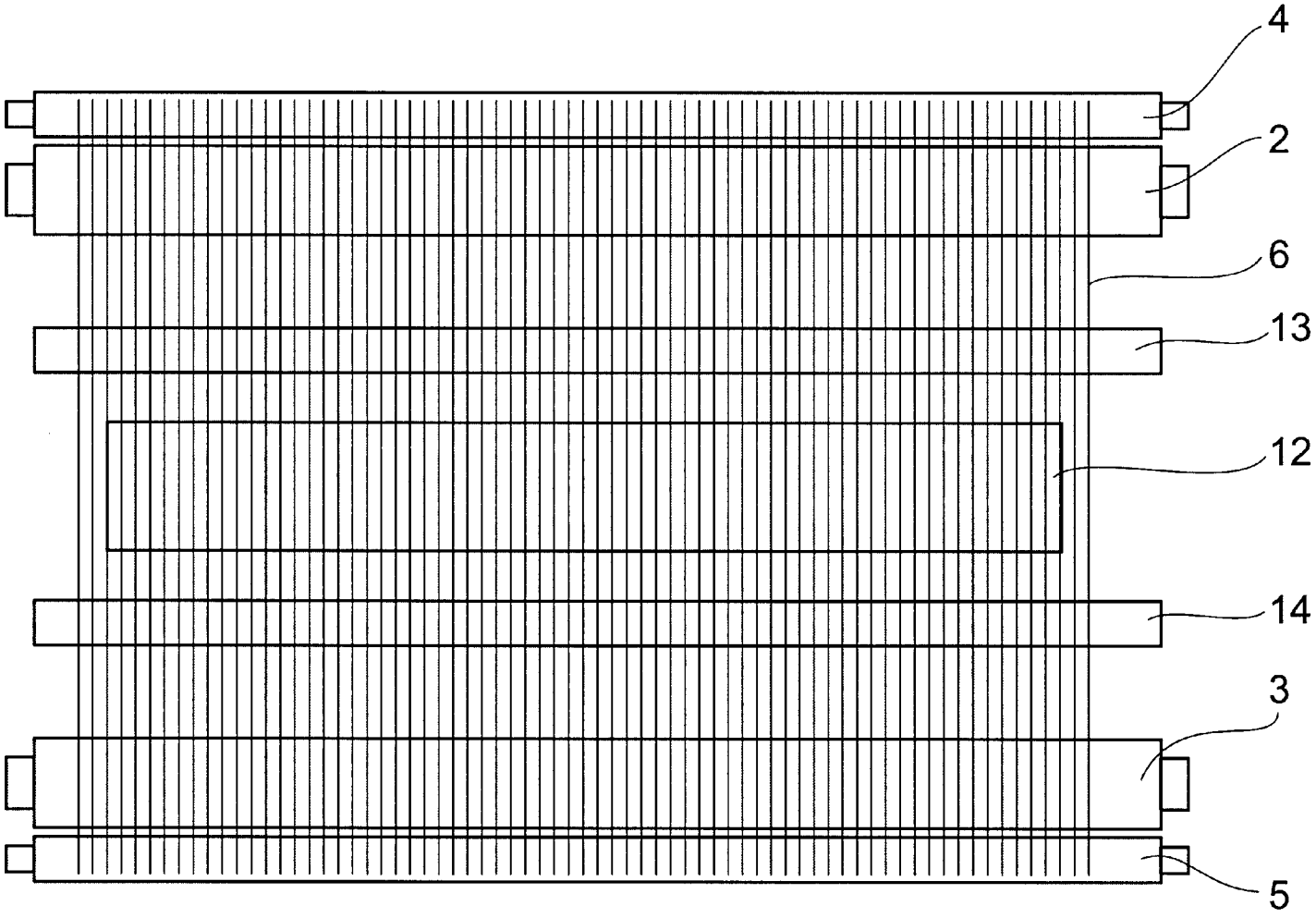
FIG. 2 is a partial top view showing a plurality of parallel stretch wires used in the present invention.

The following is a description of an embodiment of the method and device for cutting semiconductor-crystal bars according to this invention, with reference being made to the accompanying drawings. FIG. 1 is a schematic cross-sectional view showing the structure of the device for cutting a semiconductor-crystal bar, wherein the semiconductor-crystal bar is being cut. As shown in FIG. 1, an airtight vessel 1 is constituted by a vessel body 1*a* and a cover 1*b*. A couple of wire supplying-winding apparatuses 2, 3 are disposed at the upper portion of the interior of the vessel body 1*a*, and a couple of wire-tension adjusting apparatuses 4, 5 are disposed therebelow. As shown in FIG. 2, a plurality of wires 6 made of Cu are installed in such a way that one end of each wire is affixed to the wire supplying-winding apparatus 2 and is wound around thereof, while the other end of each wire is guided to pass by the wire-tension adjusting apparatuses 4, 5 and then guided to wrap around the wire supplying-winding apparatus 3 and be affixed thereto. The wires 6 are stretched under a preset tension exerted by the wire tension adjusting apparatuses 4, 5, and disposed in a horizontal plane in an equally-interval and parallel way so that wafers with preset thickness can be cut out.

An ascent/descent apparatus 7 is disposed below the vessel 1, and an ascent/descent axis 8 capable of being driven to ascend or descend by the ascent/descent apparatus 7, extends into the vessel 1 by penetrating through the bottom of the vessel body 1*a*. An ascent/descent table 9 is installed on the upper portion of the ascent/descent axis 8, and a feeding table 10 capable of horizontally shifting in a direction perpendicular to the wires 6 between the wire-tension adjusting apparatuses 4, 5, is disposed on the ascent/descent table 9. A semiconductor-crystal bar 12 is affixed on the feeding table 10 via a slice-base 11, the semiconductor-crystal bar 12 can be directed to move in the vertical and horizontal directions by the ascent/descent table 9 and the feeding table 10. Furthermore, two electrodes 13, 14 used respectively to supply electric current to each wire 6, are brought into contact with each wire 6. The electrodes 13, 14 are disposed at the middle sites respectively between the wire-tension adjusting apparatus 4 and the central line of the ascent/descent axis 8, or between the wire-tension adjusting apparatus 5 and the central line of the ascent/descent axis 8. The electrodes 13, 14 and the feeding table 10 are connected via an electric current control circuit (not shown), and each electric current control circuit is connected to a central control circuit (not shown). The magnitude of the current supplied to the electrodes 13, 14 is controlled by the central control circuit.

Heater 16 for heating the high-insulation oil 15, which is filled into the vessel body 1*a*, is disposed on the bottom of the vessel body 1*a*. An oil tank 17 for storing high-insulation oil and a container 18 for storing inert gas are installed outside the airtight vessel 1. The oil tank 17 is connected to the vessel body 1*a* via pipes 19, 20, and a filter apparatus (not shown) can be installed at any location of the pipes 19, 20. The vessel body 1*a* is connected to the container 18 via a pipe 21, and an exhaust-gas tank (not shown) is connected to the vessel body 1*a* via a pipe 22. The inert gas stored in the container 18 could be the Argon expelled from the semiconductor single-crystal manufacturing devices by the CZ method or the FZ method. There is no need to use high-purity inert gas.

The following is a description of the processes for cutting semiconductor-crystal bars when using the above-described device. At first, the semiconductor-crystal bar 12 which is to be cut is affixed to the slice-base 11. The slice-base 11 made of carbon may be a flat plate or a plate having an upper arc-shaped concave surface. A semiconductor-crystal bar having an orientation flat is secured by abutting its orientation flat on the slice-base 11. While a semiconductor-crystal bar without any orientation flat is secured on the slice-base 11 at a preset site, which is determined based on the crystal orientation and is situated on its outer peripheral surface.

Then, the ascent/descent apparatus 7 is driven to lower the ascent/descent table 9 to its lowest point, and subsequently the slice-base 11 with a semiconductor-crystal bar secured thereon is fixed to the feeding table 10. At this point, the semiconductor-crystal bar 12 is secured in such a way that its axis is perpendicular to the central lines of the wires 6; sometimes, due to the crystal orientation, the axis of the semiconductor-crystal bar 12 is not kept perpendicular to the central lines of the wires 6. After fixing the semiconductor-crystal bar 12 together with the slice-base 11 on the feeding table 10, high-insulation oil 15 is pumped into the vessel body 1*a* from the oil tank 17. High-insulation oil 15 is pumped into the vessel body 1*a* to such a level that even if the semiconductor-crystal bar 12 ascends to its highest possible point, the semiconductor-crystal bar 12 will not come out from within the liquid surface. Finally, the vessel body 1*a* is covered with the cover 1*b* to keep airtight.

If the resistance of the semiconductor-crystal bar to be cut exceeds 1 Ω·cm, it is difficult to have enough electric current produced between the semiconductor-crystal bar and the wires to perform cutting at room temperature. Therefore, the semiconductor-crystal bar is cut under a condition where it is heated to a low-resistance state. Before heating the semiconductor-crystal bar 12, inert gas is injected via pipe 21 from the container 18 into the space above the high-insulation oil 15 and pumped into the airtight vessel 1, and the air detained in the above space is expelled through the pipe 22. The pipe 22 is closed after the expelling of the air. After the space within the airtight vessel 1 has been filled with inert gas, the high-insulation oil 15 is heated by the heaters 16 and maintained at a temperature of 150° C. or higher.

In the process of cutting the semiconductor-crystal bar 12, a motor (not shown) connected to the wire supplying-winding apparatus 3 is driven to rewind the wires 6 wound around the wire supplying-winding apparatus 2 by way of the wire-tension adjusting apparatuses 4, 5. At the same time, a predetermined electric current is applied to the electrode 13, and the ascent/descent apparatus 7 is driven to raise the ascent/descent table 9 gradually. Consequently, the semiconductor-crystal bar 12 is brought towards the wires 6 and electric discharging occurs between the semiconductor-crystal bar 12 and the wires 6 so as to cut the semiconductor-crystal bar 12. The resistance of the semiconductor-crystal bar 12 is reduced by heating, therefore a cutting speed in compliance with the needs of the industry can be obtained.

After the cutting has proceeded to a depth equivalent to half the thickness of the slice-base 11, the semiconductor crystal bar 12 is lowered together with the ascent/descent table 9. Then, the feeding table 10 is driven to shift the semiconductor-crystal bar 12 only a predetermined span which is equal to the length of the processed semiconductor crystal bar from which the wafers have been cut out; after this, the next cutting proceeds. The cracking of the undermost cutout edge of the semiconductor-crystal bar 12 can be prevented by lowering the cutting to reach a depth equivalent to half the thickness of the slice-base 11. If the wires 6 is almost wound around the wire supplying-winding apparatus 3, then cutting proceeds via the driving of a motor (not shown) connected to the wire supplying-winding apparatus 2, which proceeds to rewind the wires 6 wound around the wire supplying-winding apparatus 3 through the wire-tension adjusting apparatuses 5, 4. At this point, electric current is guided into the electrode 14.

After the entire cutting has been performed, the ascent/descent table 9 is lowered together with the semiconductor-crystal bar 12. Then, electric current that has been fed into the heaters 16 is halted to cool down the high-insulation oil 15. Subsequently, inert gas is expelled into an exhaust gas tank (not shown) through the pipe 22, and the high-insulation oil 15 is guided to flow back to the oil tank 17 through the pipe 20. Then, the cover 1*b* is removed to take out the semiconductor-crystal bar 12 and the slice-base 11. Finally, the sliced semiconductor wafers are detached from the slice-base 11.

If the resistance of the semiconductor-crystal bar to be cut is less than 1 Ω·cm, it is possible to apply enough electric current between the semiconductor-crystal bar and the wires to perform cutting without heating the semiconductor-crystal bar. After affixing the semiconductor-crystal bar 12 together with the slice-base 11 onto the feeding table 10, high-insulation oil 15 is then pumped into the airtight vessel 1. Then, the cover 1*b* is installed on the airtight vessel 1 so as to keep the vessel airtight and thus allow cutting to proceed without delays. The processes followed during cutting are the same as those followed when cutting the semiconductor-crystal bar 12, the resistance of which exceeds 1 Ω·cm. It is also advisable to keep the top of the airtight vessel 1 open without installing the cover 1*b* whilst performing cutting procedures.

In this embodiment, although high-insulation oil is used as an insulation fluid, this is not the only possible choice. When the resistance of the semiconductor-crystal bar is less than 1 Ω·cm, the airtight vessel 1 can also be filled with dry air or inert gas such as Argon. If cutting is performed within an inert gas atmosphere, only insignificant amounts of pollution exist in an extremely shallow surface layer, color-change is trivial, and formation of oxidation film barely occurs.

The cutting speed is set to be 30 mm/min when a cutting operation is performed in accordance with this invention on a semiconductor-crystal bar whose resistance is less than 1 Ω·cm. In this case, it is preferable that the cutting speed is set in the range of 5 to 50 mm/min. In addition, the kerf loss suffered by using this invention is less than that suffered with wire-saw cutting since with this invention, grind particles are not used. Furthermore, an impurity-analysis result obtained by a secondary ion mass spectroscope, regarding the cutout surfaces of wafers cut out according to this invention, shows that Cu was not found at locations deeper than 0.4 μm from the outer peripheral surface of the wafers. Further, even if the resistance of the semiconductor-crystal bar is more than 1 Ω·cm, the same result could be obtained.

Based on this invention, the Electric Discharge Machining Technology can be employed in cutting various semiconductor-crystal bars including single-crystal silicon ingots, and therefore semiconductor-crystal bars can be cut rapidly at low cost. In particular, in the process of cutting a high-resistance semiconductor-crystal bar that is difficult to cut by electric discharging, inert gas is filled into the space above the high-insulation oil into which the semiconductor-crystal bar is dipped. Subsequently, high-insulation oil is heated to reduce the resistance of the semiconductor-crystal bar to facilitate cutting. Therefore, it is easy to perform cutting, and burning or flaming of the high-insulation oil can be prevented. Furthermore, it is possible to reuse expelled inert gas; therefore the cost of cutting operations can be reduced.

What is claimed is:

1. A device for cutting a semiconductor-crystal bar comprising:

a plurality of wires stretched in parallel;

means for shifting said wires constantly in an axial direction of said wires;

means for supplying electric current to said wires;

means for heating a high-insulation oil into which said wires and the semiconductor-crystal bar to be cut are dipped;

means for holding the semiconductor-crystal bar and shifting the semiconductor-crystal bar relative to said wires in the vertical and the horizontal directions;

an airtight vessel for accommodating said shifting means, supplying means, heating means and holding means therein;

means for supplying and expelling inert gas that is filled into a space within said airtight vessel and above the high-insulation oil; and means for supplying and expelling the high-insulation oil.

2. A method for cutting a semiconductor-crystal bar comprising the steps of:

providing a plurality of stretched cutting wires for cutting the semiconductor-crystal bar;

supplying electric current to the stretched wires; and cutting the semiconductor-crystal bar through electric discharging rendered by the electric current.

3. The method for cutting a semiconductor-crystal bar as claimed in claim 1, wherein said cutting operation is performed after heating the semiconductor-crystal bar to a temperature higher than room temperature.

4. The method for cutting a semiconductor-crystal bar as claimed in claim 3, wherein when the resistance of the semiconductor-crystal bar exceeds 1 Ω·cm, the semiconductor-crystal bar is heated.

5. The method for cutting a semiconductor-crystal bar as claimed in claim 2, wherein cutting is performed in an inert gas atmosphere.

6. The method for cutting a semiconductor-crystal bar as claimed in claim 2, wherein said method further comprises the steps of:

providing an airtight vessel;

filling a portion of the airtight vessel with a high insulation oil;

filling inert gas into a space within the airtight vessel and above the high-insulation oil stored therein, and creating electric discharging between the semiconductor-crystal bar and the wires while at least part of the wires and the semiconductor-crystal bar are dipped into the high-insulation oil, wherein said cutting operation is performed after the process of heating and keeping the high-insulation oil at a temperature higher than 150° C. to reduce the resistance of the semiconductor-crystal bar.

7. A device for cutting a semiconductor-crystal bar comprising:

a plurality of wires stretched in parallel;

a winding apparatus for shifting said wires in an axial direction of said wires;

an electrode for supplying electric current to said wires;

a heater for heating a high-insulation oil into which said wires and the semiconductor-crystal bar to be cut are dipped;

a table support for supporting the semiconductor-crystal bar;

an airtight vessel for accommodating said winding apparatus, electrode, heater and table support therein;

a first gas conduit for supplying an inert gas into a space within said airtight vessel above the high-insulation oil;

a second gas conduit for expelling the inert gas from said airtight vessel;

a first oil conduit for supplying the high-insulation oil to the airtight vessel; and a second oil conduit for expelling the high-insulation oil from the airtight vessel.

* * * * *